US010113727B2

(12) United States Patent
Zhu

(10) Patent No.: US 10,113,727 B2
(45) Date of Patent: Oct. 30, 2018

(54) LAMP WITH INDIVIDUALLY ROTATABLE LIGHT EMITTING MODULES

(71) Applicant: Ningbo Hengjian Photoelectron Technology Co., Ltd., Ningbo (CN)

(72) Inventor: Jianjun Zhu, Ningbo (CN)

(73) Assignee: Ningbo Hengjian Photoelectron Technology Co., Ltd., Ningbo (CN)

( * ) Notice: Subject to any disclaimer, the term of this patent is extended or adjusted under 35 U.S.C. 154(b) by 37 days.

(21) Appl. No.: 15/464,359

(22) Filed: Mar. 21, 2017

(65) Prior Publication Data

US 2018/0180270 A1 Jun. 28, 2018

(30) Foreign Application Priority Data

Dec. 23, 2016 (CN) ..... 2016 2 1421295 U
Dec. 23, 2016 (CN) ..... 2016 2 1421407 U

(51) Int. Cl.
*F21V 21/30* (2006.01)
*F21S 8/06* (2006.01)
*F21V 21/112* (2006.01)

(52) U.S. Cl.
CPC ..... *F21V 21/30* (2013.01); *F21S 8/061* (2013.01); *F21S 8/063* (2013.01); *F21V 21/112* (2013.01)

(58) Field of Classification Search
CPC ..... F21V 21/30; F21V 14/02; F21V 17/02; F21V 17/06; F21V 17/107; F21V 17/18; F21S 8/04; F21S 8/043; F21S 8/046
See application file for complete search history.

(56) References Cited

U.S. PATENT DOCUMENTS 6,502,967 B2 * 1/2003 Mullen ..... F21S 8/022 362/285
8,025,422 B1 * 9/2011 Huang ..... F21V 3/02 362/241
8,029,173 B2 * 10/2011 Ko ..... B60Q 1/0483 362/427
8,066,404 B2 * 11/2011 Song ..... F21S 2/005 257/722
8,157,420 B2 * 4/2012 Song ..... F21V 15/013 362/294
8,408,742 B2 * 4/2013 Tran ..... F21V 19/0045 362/171
8,911,116 B2 * 12/2014 Blincoe ..... F21V 7/00 362/249.02
9,494,306 B1 * 11/2016 Newton ..... F21V 15/01
9,739,462 B2 * 8/2017 Georgitsis ..... F21V 5/007
2010/0214782 A1 * 8/2010 Allegri ..... F21S 10/00 362/249.07
2012/0069582 A1 * 3/2012 Chang ..... F21S 8/043 362/371
2013/0308325 A1 * 11/2013 Verfuerth ..... F21V 21/30 362/371

* cited by examiner

*Primary Examiner* — Ismael Negron
(74) *Attorney, Agent, or Firm* — Gokalp Bayramoglu

(57) ABSTRACT

The lamp includes a plurality of light emitting modules each having a protruding pillar at both ends, and a lamp holder with two end frame each having a curved groove. The light emitting modules are rotatably coupled to the lamp holder through a shaft attached to the end frames, such that each protruding pillar is received in one of the curve grooves. Each one of the light emitting modules being rotatable about the shaft with the pillar sliding within the groove, to adjust the direction of emitted light.

12 Claims, 6 Drawing Sheets

LAMP WITH INDIVIDUALLY ROTATABLE LIGHT EMITTING MODULES

CROSS REFERENCE TO RELATED APPLICATIONS

This application claims priority to Chinese Application No. CN201621421407.2, filed on Dec. 23, 2016, and claims priority to Chinese Application No. CN 201621421295.0, filed on Dec. 23, 2016, the entire contents of which are incorporated herein by reference.

TECHNICAL FIELD

The present disclosure relates to a field of lamps and lanterns, and more particularly to a lamp of hanging type.

BACKGROUND

Lamps are instruments used to produce, disperse or alter distribution of light, and may comprise hanging lamps, wall lamps, and ceiling lamps, etc. Hanging lamps are very often applied to a ceiling of, for example, a garage. A hanging lamp may comprise a frame and one or more light emitting modules. The number of light emitting modules may be determined according to the size of interior room space. Existing hanging lamps are attached to a ceiling through either a holder or a hanging wire. These two approaches to secure hanging lamps to a ceiling possess distinguishing characteristics. A Lamp secured by a holder may be more stable and less subject to waggling movement. A Lamp secured by a hanging wire may be adjustable in height depending on interior room space to reach a preferable illumination effect. However, existing hanging lamps are limited to either one of these two approaches, leaving a user no option to choose between alternate approaches based on his or her actual needs. Existing hanging lamps also suffer from an inability to adjust the emitting angle of their light emitting modules once installed. A favorable illuminating condition would be difficult to achieve if the installation position of a lamp on ceiling is limited due to small interior room space.

SUMMARY OF THE INVENTION

Exemplary embodiments of the present disclosure include a lamp of hanging type comprising a plurality of light emitting modules and a lamp holder, wherein the lamp holder comprises two end frames to support the plurality of light emitting modules, each light emitting module is hinged to the end frames through a hinge shaft, each light emitting module is configured to be rotatable around the axis of the hinge shaft, each light emitting module comprise a convex pillar on each end, and a curved groove shaped as a first arc is positioned on each end frame to receive the convex pillar.

In some embodiments, each light emitting module further comprises a positioning bump; and each frame further comprises a plurality of positioning holes to receive the positioning bump.

In some embodiments, the centers of the positioning holes are positioned along a second arc.

In some embodiments, the first arc and the second arc share the same center of circle.

In some embodiments, the center of circle coincides with the axis of the hinge shaft.

In some embodiments, the radian of the first arc is equal to or greater than the radian of the second arc.

In some embodiments, the radian of the first arc is within a range of 0~180 degrees.

In some embodiments, the radian of the first are is 120 degrees.

In some embodiments, the positioning bump is arranged on an elastic tablet attached to the end of each light emitting module.

In some embodiments, the end frame further comprises two mounting holders, four fixing plates and four hanging plates.

In some embodiments, each mounting holder is detachably attached to two fixing plates.

In some embodiments, each fixing plate is detachably attached to one hanging plate.

In some embodiments, each fixing plate further comprises one or more hanging holes.

Exemplary embodiments of the present disclosure would be useful in solving at least one of the problems of the prior arts discussed above. One advantage of the embodiments is achieved by fixing the lamp with both a holder and a hanging wire so that a user would be enabled to choose a proper fixing mechanism as need in any specific situation. Another advantage of the embodiments is that the user would be enabled to adjust the emission angle of light.

BRIEF DESCRIPTION OF THE DRAWINGS

Embodiments of the invention are illustrated by way of example, and not by way of limitation, in the figures of the accompanying drawings in which reference numerals refer to similar elements.

Reference Numbers: 1, lamp holder, 2, light emitting module, 3, end frame, 3.1, curved groove, 3.2, mounting plate, 3.3, end cap, 3.4, hinge shaft, 4, bar, 5, positioning bump, 6, positioning hole, 7, convex pillar, 8, elastic tablet, 9, elastic tablet opening, 10, mounting holder, 11, fixing plate, 11.1, hanging hole, 12, hanging plate

DETAILED DESCRIPTION OF THE INVENTION

The following description is presented to enable those skilled in the art to make and use the embodiments, and is provided in the context of a particular application and its requirements. Various modifications to the disclosed embodiments will be readily apparent to those skilled in the art upon reading the following description, and the general principles defined herein may be applied to other embodiments and applications without departing from the spirit and scope of the present disclosure. Therefore, the present disclosure is not limited to the embodiments shown, but is to be accorded the widest scope consistent with the principles and concepts disclosed herein.

Moreover, the term "and/or" may mean "and," it may mean "or", it may "exclusive or", it may mean "one", it may mean "some, but not all", it may mean "neither," and/or it may mean "both", although the scope of claimed subject matter is not limited in this respect. In the following description and/or claims, the terms "comprise" and "include", along with their derivatives, may be used and are intended as synonyms for each other.

Figure 1:
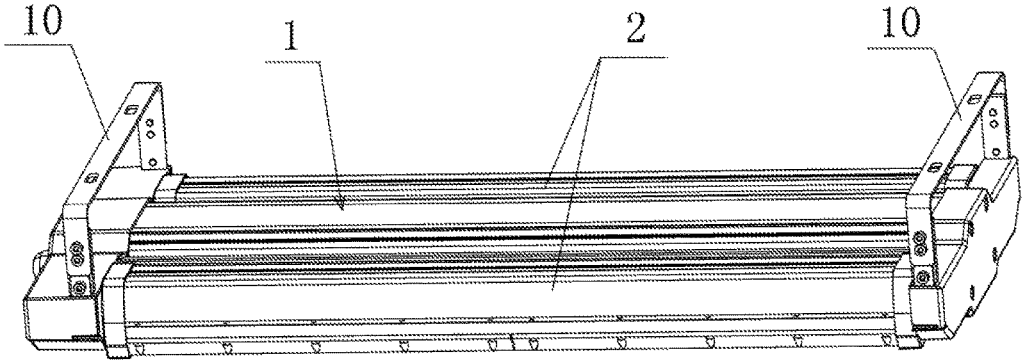
FIG. 1 illustrates the three-dimensional structure of a lamp of hanging type according to an embodiment.

As shown in FIG. 1, a lamp of hanging type according to an embodiment of the present disclosure includes a lamp holder 1 and a plurality of light emitting modules 2. Although two are shown in the figures, the skilled in the art would anticipate that more than two light emitting modules 2 are possible. The two ends of a light emitting module 2 connect to the lamp holder 1 in a fashion that the light emitting module 2 is rotatable around it axis. The rotatable light emitting module 2 allows a user to adjust the emitting angle of light during usage. Two mounting holders 10 are also shown in FIG. 1 which could be used to secure the lamp to a ceiling.

Figure 2:
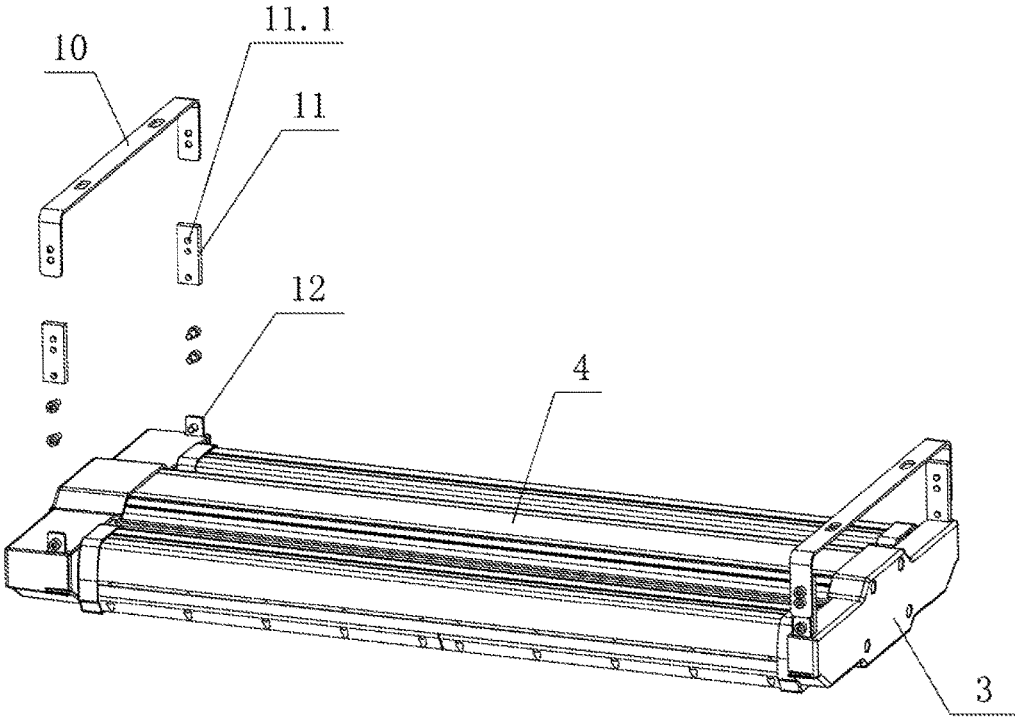
FIG. 2 illustrates the explosive view of part of a lamp of hanging type according to an embodiment.

As shown in FIG. 2, the lamp holder 1 comprises two end frames 3. The end frames 3 are located on two opposite ends of the lamp holder 1. Each end of a light emitting module 2 is hinged to a respective end frame 3. Positioning components are arranged between the end of a light emitting module 2 and a corresponding end frame 3. Details on the structures of the positioning components will be provided hereinafter. The two end frames 3 are connected to each other by a bar 4. In an embodiment, the bar 4 is arranged between two light emitting modules 2.

FIG. 2 further shows that the mounting holders 10 are arranged on the end frames 3 of both ends of the lamp holder 1. Fixing plates 11 are arranged on both ends of the lamp holder 1. In particular, the two sides of a mounting holder 10 are connected to the two fixing plates respectively. The mounting holders 10 are detachably connected to corresponding fixing plates 11. A fixing plate 11 also comprises one or more hanging holes 11.1 in some embodiments. The hanging holes 11.1 may be used to connect to the mounting holders 10, and may also be used with a hanging wire to simply the structure of the fixing plates 11. By providing the two options to use the hanging holes 11.1, a user would be enabled to install the lamp in a preferable way.

Figure 3:
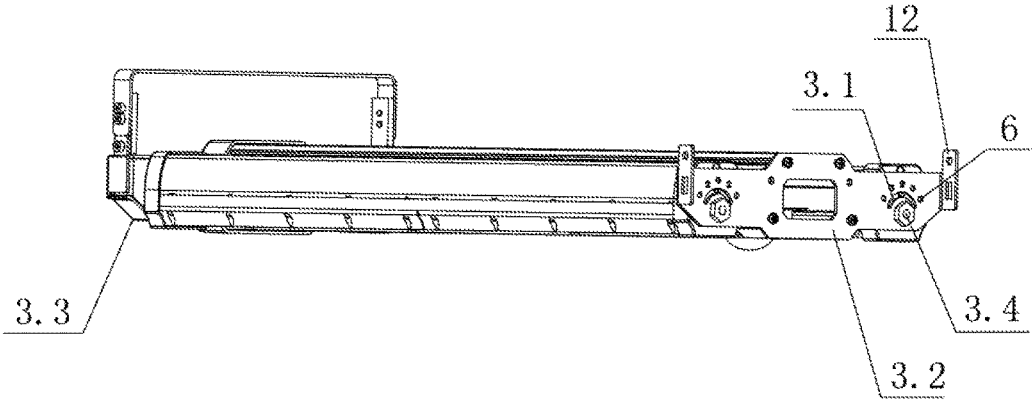
FIG. 3 illustrates the three-dimensional structure of one part of a lamp of hanging type according to an embodiment.
Figure 4:
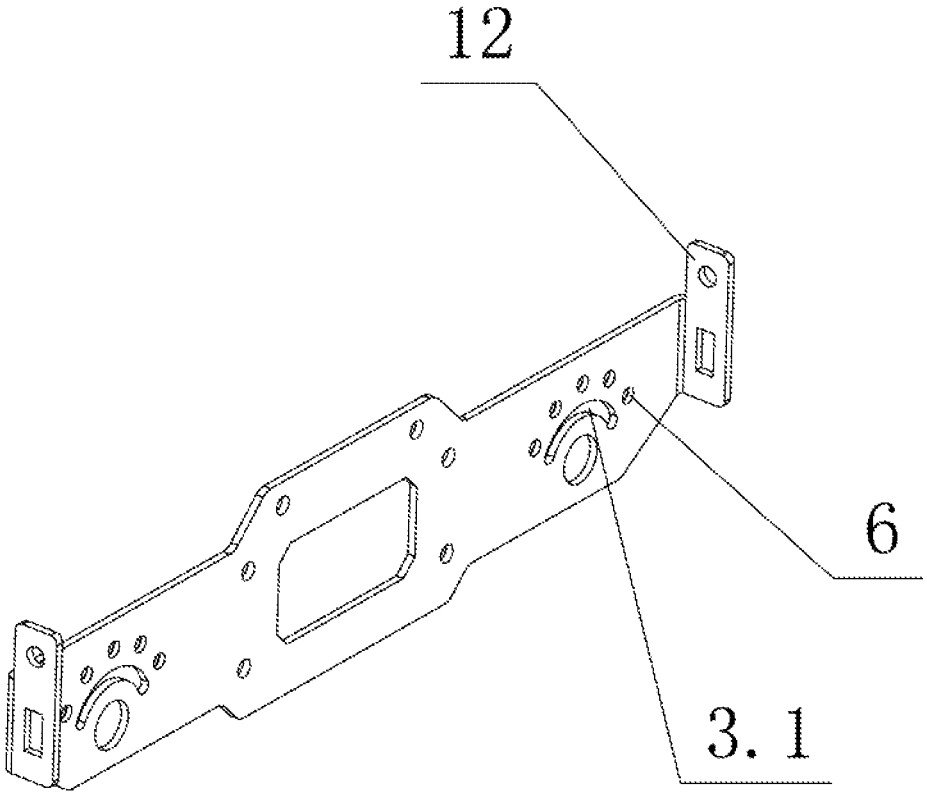
FIG. 4 illustrates the three-dimensional structure of a mounting plate of a lamp of hanging type according to an embodiment.

FIG. 3 shows the ends of a light emitting module 2 are hinged to the lamp holder 1 by a hinge shaft 3.4. The light emitting module 2 may rotate around the axis of the hinge shaft 3.4. Positioning components arranged between the end of a light emitting module 2 and a corresponding end frame 3 comprise a positioning bump 5 and a plurality of positioning holes 6. The positioning bump 5 is arranged on the ends of the light emitting module 2. The positioning holes 6 are arranged on the side wall of each end frame 3 which is adjacent to the light emitting module 2. The centers of the plurality of positioning holes 6 form an arc which has a center coinciding with the axis of the hinge shaft 3.4. While FIGS. 3 and 4 show five positioning holes 6 located above the hinge shaft 3.4, the number of positioning holes is not limited in this sense. The positioning holes 6 are used to confine the positioning bump 5 as the light emitting module 2 is rotated to a chosen angle. Therefore, the distribution of positioning holes can be determined based on the choices of light emitting angles by a user. In an embodiment where the light emitting module 2 emits light within a range of 30 degrees, six positioning holes may be provided to enable emitting angles between 0 and 180 degrees. In FIG. 4, hanging plates 12 are arranged on both sides near the ends of the lamp holder 1. Each fixing plate 11 can be detachably connected to a hanging plate 12 during usage. In the embodiment where four fixing plates 11 are provided, four hanging plate 12 are arranged correspondingly.

As shown in FIGS. 3 and 4, the end frame 3 comprises two mounting plates 3.2 and an end cap 3.3. The mounting plates 3.2 are arranged on two opposite ends of the lamp holder 3. The end cap 3.3 is caped on one of the two mounting plates 3.2 and fixed connected thereto. The end cap 3.3 is used to form an inner space with the mounting plate 3.2 to contain electrical components such as wires leading from inside the lamp. A via is opened on the end cap 3.3 which allows at least a part of hanging plate 12 to protrude from the end cap 3.3. The hinge shaft 3.4 is hinged to the mounting plate 3.2. Besides the positioning holes 6, a curved groove 3.1 is arranged on the mounting plate 3.2. The hanging plates 12 are arranged on the upper part of the mounting plate 3.2.

Figure 5:
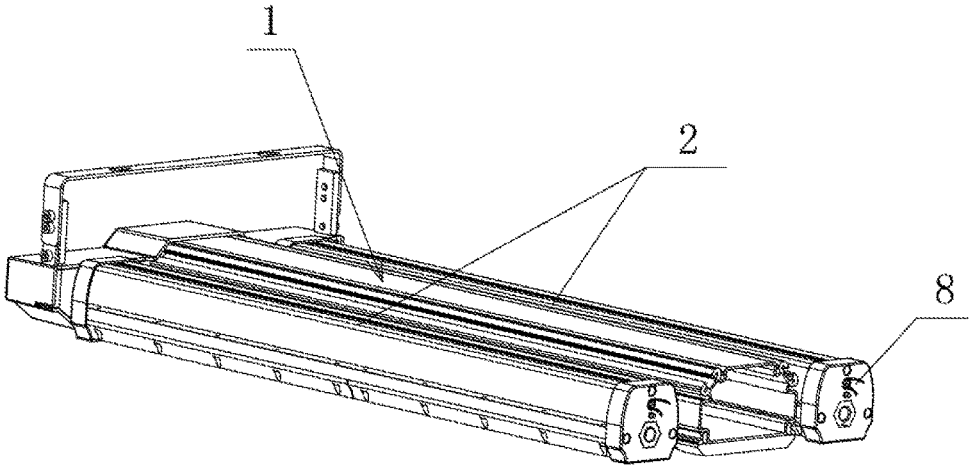
FIG. 5 illustrates the three-dimensional structure of one part of a lamp of hanging type according to an embodiment.
Figure 6:
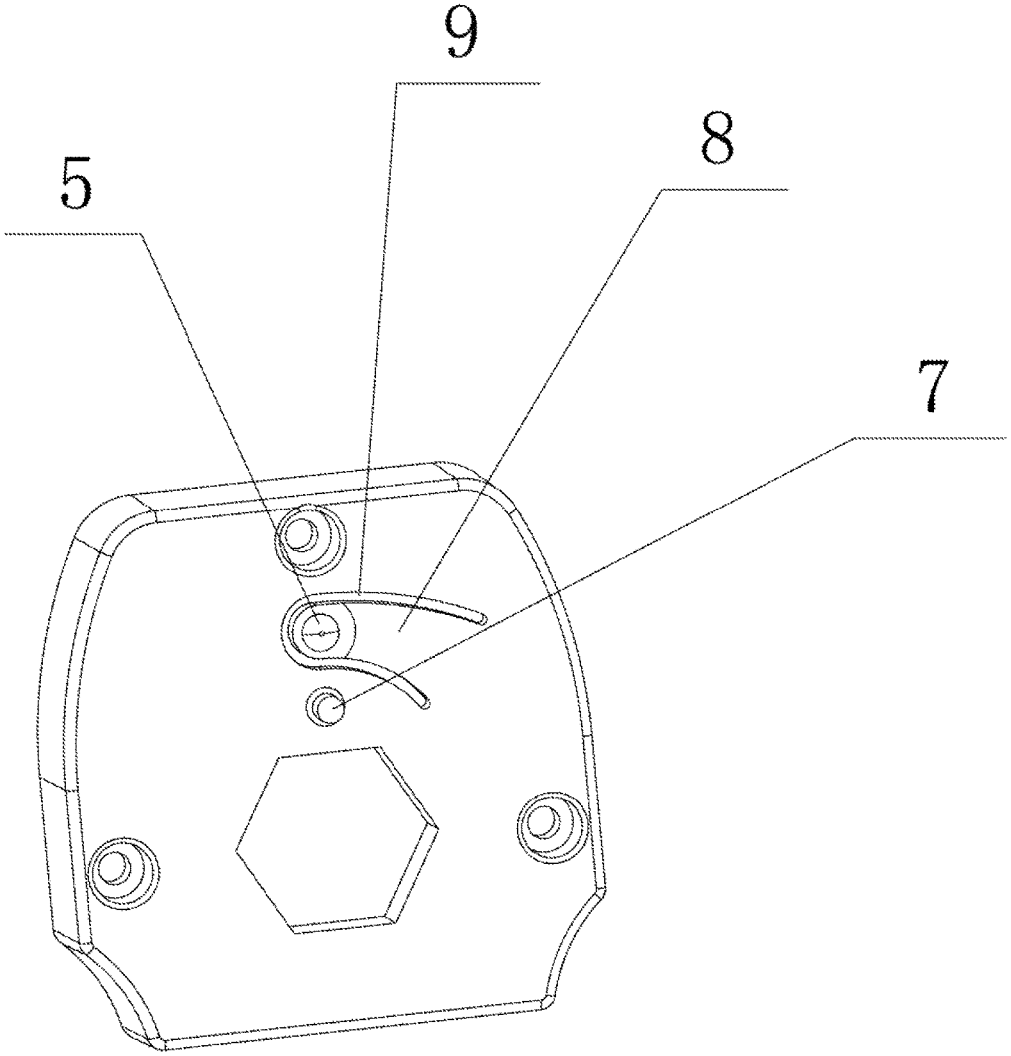
FIG. 6 illustrates the three-dimensional structure of an end part of a lamp of hanging type according to an embodiment.

FIGS. 5 and 6 show in detail the positioning components between the light emitting module 2 and the end frame 3. A convex pillar 7 is arranged on each of the two end faces of the light emitting module 2. The convex pillar 7 is movable within the curved groove 3.1 which is positioned on the end frame 3 close to the end face of the light emitting module 2. The curved groove 3.1 is shaped as an arc which shares the same center of circle with the arc formed by the plurality of positioning holes 6. Further, the radian of the curved groove 3.1 is equal to or greater than the radian of the are formed by the plurality of positioning holes 6. In some embodiments, the convex pillar 7 is configured to slide within the curved groove 3.1. The radian of the curved groove 3.1 can be chosen within a range between 0 and 180 degrees. In the exemplary embodiment as illustrated in the figures, the radian of the curved groove 3.1 is 120 degrees.

The positioning bump 5 is arranged on an elastic tablet 8 which is connected to the end face of the light emitting module 2. As shown in FIG. 6, the elastic tablet 8 is kept within an elastic tablet opening 9 on the end face of the light emitting module 2. One end of the elastic tablet 8 is connected to edge of the elastic tablet opening 9. The positioning bump 5 is deployed on the other end of the elastic tablet 8 and near the surface of the end frame 3. The positioning bump 5, the elastic tablet 8 and the end face of the light emitting module 2 can be molded or shaped as a whole unit. A user may press the elastic tablet 8 and rotate the light emitting module 2 at the same while so that the positioning bump 5 is fit into different positioning holes 6 to achieve different angles of light emission.

As noted above, particular terminology used when describing certain features or aspects of the disclosure should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above detailed description explicitly defines such terms. Accordingly, the actual scope of the invention encompasses not only the disclosed examples, but also all equivalent ways of practicing or implementing the invention under the claims.

What is claimed is:

1. A lamp configured to be supported from above, the lamp comprising: a plurality of light emitting modules having a protruding pillar and a shaft at each end; and a lamp holder including two end frames to support the plurality of light emitting modules, each of the two end frames having a curved groove defining a first arc and a pivot hole, wherein each shaft of each of the plurality of light emitting modules is rotatably received in one of the pivot holes and each protruding pillar is received in one of the curved grooves, each of the plurality of light emitting modules is configured to be rotatable about an axis defined by the shafts, a positioning bump is included in each of the plurality of light emitting modules, and a plurality of positioning holes are formed in the two end frames to receive the positioning bumps.

2. The lamp of claim 1, wherein centers of the positioning holes are positioned along a second arc.

3. The lamp of claim 2, wherein the first arc and the second arc have a same center.

4. The lamp of claim 3, wherein the center of the first arc and second arc is located along an axis of the shaft.

5. The lamp of claim 3, wherein an angular extension of the first arc is equal to or greater than an angular extension of the second arc.

6. The lamp of claim 3, wherein an angular extension of the first arc is within a range of 0-180 degrees.

7. The lamp of claim 3, wherein an angular extension of the first arc is 120 degrees.

8. The lamp of claim 3, wherein each positioning bump is formed on a resilient tongue located at an end of each of the plurality of the light emitting modules.

9. The lamp of claim 3, wherein each of the two end frames further comprises two mounting holders, four fixing plates and four hanging plates.

10. The lamp of claim 9, wherein each of the two mounting holders is removable attached to two of the four fixing plates.

11. The lamp of claim 10, wherein each of the four fixing plates is removable attached to one of the four hanging plates.

12. The lamp of claim 11, wherein each of the four fixing plates further comprises one or more holes.

* * * * *